United States Patent [19]

Gandy et al.

[11] 4,131,275

[45] Dec. 26, 1978

[54] ARM WRESTLING DEVICE

[76] Inventors: Eleanor J. Gandy; Ann H. Lockhart, both of 867 Maple Dr., Memphis, Tenn. 38108

[21] Appl. No.: 829,739

[22] Filed: Sep. 1, 1977

[51] Int. Cl.[2] ..... A63B 67/00; A63F 9/00

[52] U.S. Cl. ..... 273/1 R

[58] Field of Search ..... 273/1 R, 1 E, 1 M; 272/67, 136, 141, 1

[56] References Cited

U.S. PATENT DOCUMENTS

| | | | |
|---|---|---|---|
| 2,782,033 | 2/1957 | Ugartechea | 272/136 |
| 3,059,476 | 10/1962 | Spradlin | 272/67 X |
| 3,400,793 | 9/1968 | Norris et al. | 273/1 R UX |
| 3,467,376 | 9/1969 | Feinberg | 272/67 X |
| 3,649,010 | 3/1972 | Jeffrey et al. | 273/1 E |
| 3,743,284 | 7/1973 | Rhodes et al. | 273/1 R |

*Primary Examiner*—Paul E. Shapiro
*Attorney, Agent, or Firm*—John R. Walker, III

[57] ABSTRACT

A device for use in contests in which two contestants attempt to force one another's forearm from a substantially vertical position to a substantially horizontal position. The device includes a base for resting upon a supporting surface. The contestants sit on opposite sides of the base, facing one another. A first arm is pivotally mounted to the base in a manner so that one of the contestants can grip the distal end thereof with his elbow resting upon the base and with his forearm in a substantially vertical position. A second arm is pivotally mounted to the base in a manner so that the other contestant can grip the distal end thereof with his elbow resting upon the base and with his forearm in a substantially vertical position. The first and second arms are fixedly attached together so that when one of the arms is moved downward, the other arm is forced downward. The contestants attempt to force one another's forearm to a substantially horizontal position by moving the distal ends of the arms downward in opposite directions.

10 Claims, 8 Drawing Figures

ARM WRESTLING DEVICE

BACKGROUND OF THE INVENTION

1. Field of the Invention

This invention relates generally to game devices and more specifically to devices for use in arm wrestling and the like.

2. Description of the Prior Art

Ugartechea, U.S. Pat. No. 2,782,033 discloses a device for use in arm wrestling. This device includes a substantially U-shaped member and a pair of brackets for pivotally attaching the bottom of the U-shaped member to a table or the like. Outward extending grip members are fixedly attached to th distal end of each side of the U-shaped member for providing a handhold for each contestant. Other U.S. patents which relate generally to the present invention are: Saltz, U.S. Pat. No. 2,959,414; Weiss et al, U.S. Pat. No. 3,815,904; Wilkin, U.S. Pat. No. 3,851,874; and McDonnell, U.S. Pat. No. 3,982,757. None of the above patents disclose or suggest the present invention.

Arm wrestling is typically performed by the contestants facing one another across a table or the like and directly gripping one another's hand. However, this procedure often results in one of the contestants having an advantage over the other due to different hand sizes, finger strength, and the like thereby causing factors other than arm strength to aid in determining the winner of the contest. The Ugartechea device helps alleviate this problem. However, the Ugartechea device is disadvantageous because, for example, it must be fixedly attached to a table or the like and because the strength of both contestants is applied directly against the joint attaching each grip member to the distal end of each side of the U-shaped member thereby subjecting the joint to fatigue and continued stress.

SUMMARY OF THE INVENTION

The present invention is directed towards overcoming the problems and disadvantages of prior devices for use in and method of arm wrestling. The concept of the present invention is to provide a self-supporting, portable device which includes a base means, a first arm means having a grip member for being gripped by one contestant; a second arm means having a grip member for being gripped by the other contestant; and an attachment means for pivotally attaching the first and second arm means to the base means in such a manner that when the first or second arm means is forced to pivot downwardly by one of the contestants, the other of the first or second arm means will be forced to pivot downward a like amount. The first and second arm means cross one another in such a manner that when the first arm means is forced downward by one of the contestants it will contact and press against the second arm means at the point where the first and second arm means cross one another and that when the second arm means is forced downward by one of the contestants it will contact and press against the first arm means at the point where the first and second arm means cross one another.

DESCRIPTION OF THE PREFERRED EMBODIMENT

Figure 1:
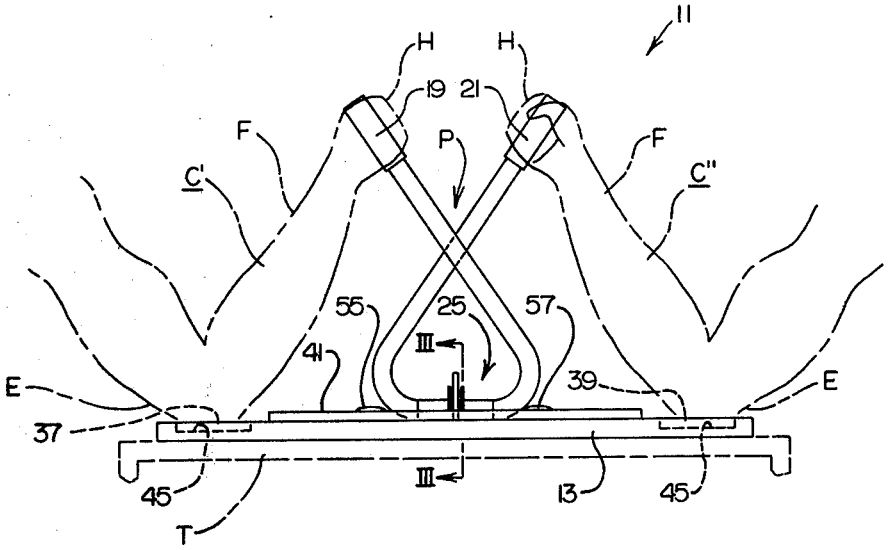
FIG. 1 is an end elevational view of the arm wrestling device of the present invention with portions of the contestants' arms shown in broken lines.

The device 11 of the present invention is for use in contests in which two contestants C', C'' attempt to force one another's forearm F from a substantially vertical position to a substantially horizontal position. The device 11 includes, in general, a base means 13, a first arm means 15, a second arm means 17, and an attachment means for pivotally attaching the first and second arm means 15, 17 to the base means 13 in such a manner than when either of the arm means 15, 17 is forced to pivot downward by one of the contestants C', C'', the other arm means 15, 17 will be forced to pivot downward a like amount.

The base means 13 is preferably constructed of a substantially flat, rigid member such as plywood or the like and is preferably substantially rectangular in shape when viewed from the top or bottom. The base means 13 is preferably of a size so that the contestants' elbows, forearms and hands will remain within the periphery of the base means 13 at all times during the contest.

The first arm means 15 includes a grip member 19 for being gripped by the contestant C'. The second arm means 17 includes a grip member 21 for being gripped by the other contestant C''. The grip members 19, 21 may be constructed of a nonslip material such as rubber and the like and may be ribbed or grooved whereby each contestant C may securely grip the arm means 15, 17. The first and second arm means 15, 17 preferably cross one another as clearly shown in FIGS. 1 and 2 in such a manner that when the first arm means 15 is forced downward by one of the contestants C', C'' the first arm means 15 will contact and press against the second arm means 17 at the point P where the first and second arm means 15, 17 cross one another and that when the second arm means 17 is forced downward by one of the contestants C', C'' the second arm means 17 will contact and press against the first arm means 15 at the point P where the first and second arm means 15, 17 cross one another (see FIGS. 1 and 2).

Figure 2:
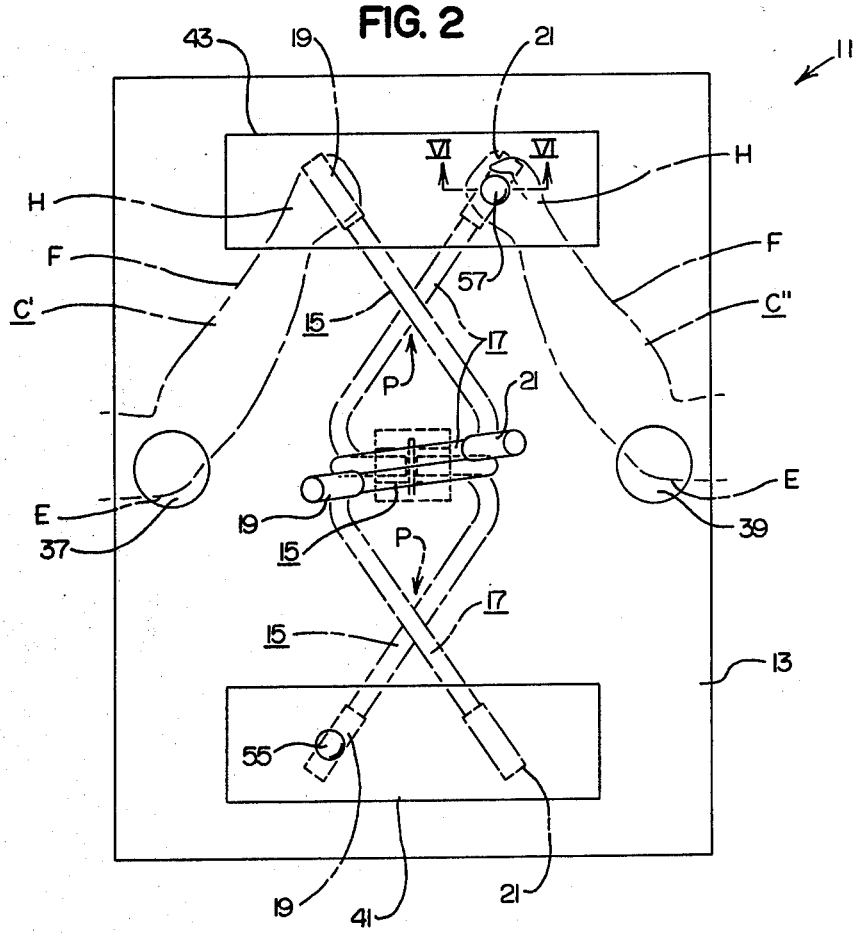
FIG. 2 is a top plan view thereof with portions of the contestants' arms and moved positions of the first and second arm means shown in broken lines.
Figure 3:
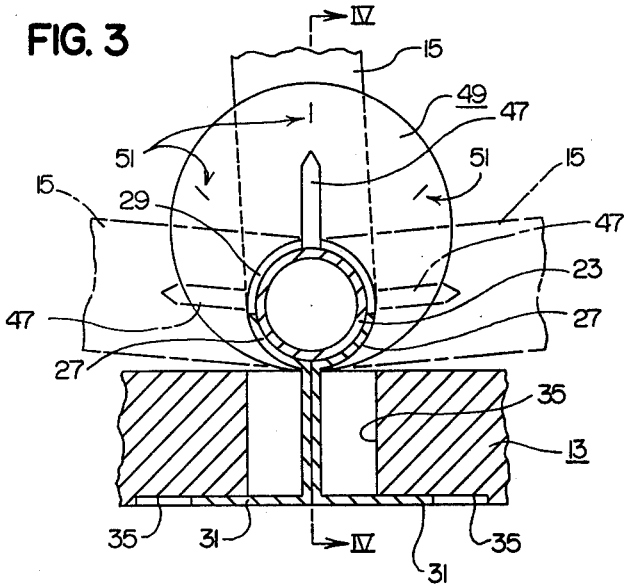
FIG. 3 is a sectional view of a portion thereof as taken on line III—III of FIG. 1.
Figure 4:
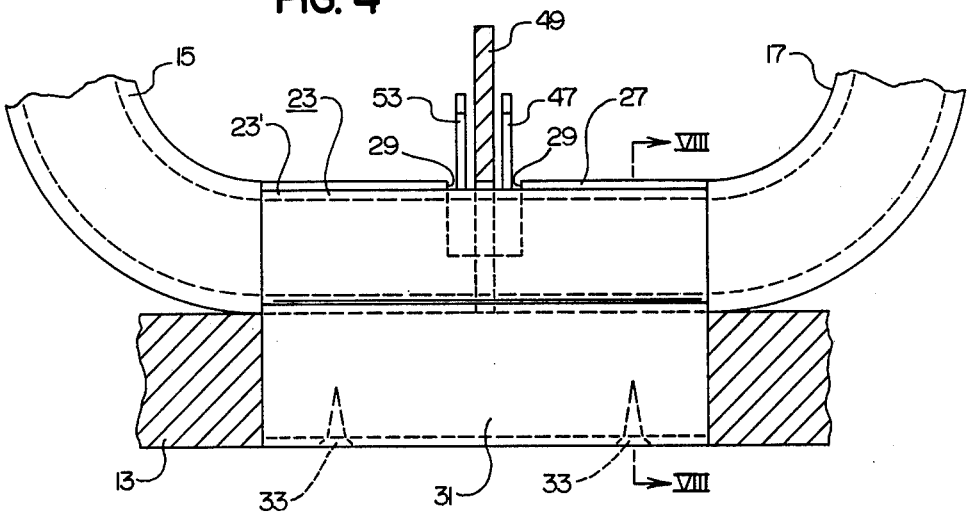
FIG. 4 is a sectional view of a portion thereof as taken on line IV—IV of FIG. 3.
Figure 5:
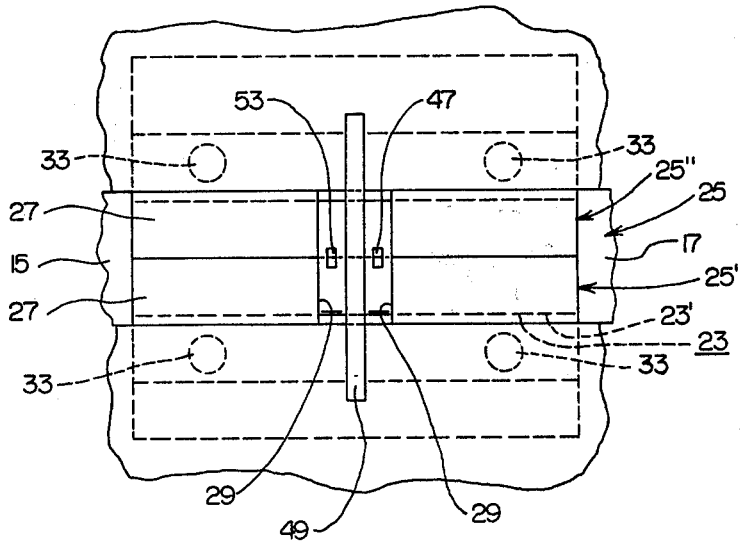
FIG. 5 is a top plan view of FIG. 4.
Figure 8:
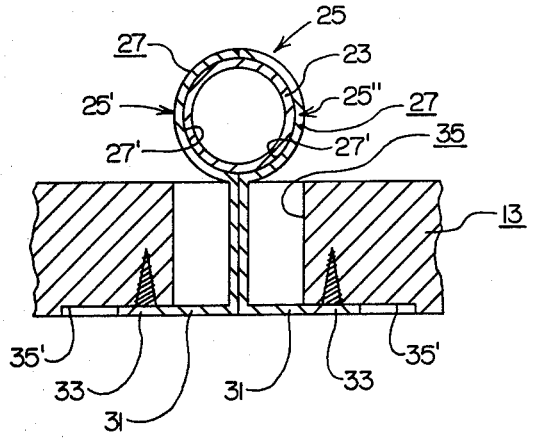
FIG. 8 is a sectional view of a portion thereof as taken on line VIII—VIII of FIG. 4.

The attachment means of the device 11 preferably includes a first member 23 for fixedly attaching the first and second arm means 15, 17 together and preferably includes a second member 25 for pivotally attaching the first member 23 to the base means 13. The first and second arm means 15, 17 and the first member 23 of the attachment means are preferably integrally joined togehter as a one-piece unit. More specifically, the first and second arm means 15, 17 and the first member 23 of the attachment means may be formed of a single, elongated metal tube bent so that the ends thereof cross over one another as clearly shown in FIGS. 1 and 2 to form the first and second arm means 15, 17 with the midportion of the elongated tube forming the first member 23 of the attachment means. The second member 25 of the attachment means may be constructed in any manner well known to those skilled in the art for pivotally attaching the first member 23 to the base means 13. Preferably, the second member 25 is formed in two halves 25', 25", each half being substantially the mirror image of the other (see, in general, FIG. 8). Each half 25', 24" preferably includes an upper end 27 having a concave portion 27' for receiving a portion of the first member 23 so that when the first member 23 is received in the concave portion 27' of both halves 25', 25", it will be substantially completely enclosed by the second member 25 as shown in FIG. 8. A notch 29 is preferably provided in each half 25', 25" through a portion of the concave portion 27 thereof (see FIGS. 3, 4 and 5) for reasons which will hereinafter become apparent. Each half 25', 25" preferably includes a lower end having a substantially L-shaped portion 31 for being fixedly attached to the base means 13 in any manner apparent to those skilled in the art such as by screws 33 or the like (see, in general, FIG. 8). The base means 13 is preferably provided with an aperture 35 for receiving the L-shaped portions 31 in such a manner that substantially none of the L-shaped portions 31 extend above the surface of the base member 13 as clearly shown in FIGS. 3 and 8. The aperture 35 may include an offset portion 35' for receiving the horizontal extension of the L-shaped portion 31 in such a manner that none of the L-shaped portions 31 extend below the bottom surface of the base means 13 as shown in FIGS. 3 and 8.

The device 11 may also include means for preventing longitudinal movement of the first member 23 of the attachment means relative to the base means 13 to thereby keep the first and second arm means 15, 17 substantially centered about the longitudinal axis of the base means 13. More specifically, the first member 23 of the attachment means may include a grooved portion 23', i.e., a portion having a reduced cross-sectional area as clearly shown in FIGS. 3 and 4, and the concave portions 27' may be sized so as to rotatably receive this reduced portion 23' but not the remainder of the first member 23 or the first and second arm means 15, 17 as clearly indicated by FIGS. 3 and 4. In this manner, once the first member 23 is rotatably attached to the base means 13 by the second member 25, the first member 23 is prevented from moving back and forth relative to its longitudinal axis as shown now be apparent to those skilled in the art.

The device 11 preferably includes a pad means attached to the base means 13 for receiving each contestant's elbow E (see FIGS. 1 and 2) and for receiving a portion of each contestant's hand H (see FIG. 2) when the first and second arm means 15, 17 are in a substantially horizontal position. The pad means preferably includes a first pad member 37 located substantially directly below the grip member 19 of the first arm means 15 when the first arm means 15 is in a substantially vertical plane for receiving the elbow E of the contestant C' gripping the grip member 19 of the first arm means 15 (see, in general, FIGS. 1 and 2). The pad means also preferably includes a second pad member 21 of the second arm means 17 when the second arm means 17 is in a substantially vertical plane for receiving the elbow E of the contestant C" gripping the grip member 21 of the second arm means 17 (see, in general, FIGS. 1 and 2). The pad means also preferably includes a third pad member 41 located substantially below the grip members 19, 21 of the first and second arm means 15, 17 when the first arm means 15 has been forced into a substantially horizontal plane for receiving a portion of the hands H of both contestants C', C" (see FIG. 2). Finally, the pad means preferably includes a fourth pad member 43 located substantially directly below the grip members 19, 21 of the first and second arm means 15, 17 when the second arm means 17 has been forced into a substantially horizontal plane for receiving a portion of the hands H of both contestants C', C" (see FIG. 2). The pad means is preferably constructed of a resilient material such as foam rubber or the like and may be attached to the base means 13 in any manner apparent to those skilled in the art such as by glue or the like. The first and second pad members 37, 39 are preferably recessed into the base means 13. The base means 13 is preferably provided with recessed portions 45 to receive the first and second pad members 37, 39 as clearly shown in FIG. 1. The third and fourth pad members 41, 43 preferably extend above the top surface of the base means 13 as shown in FIG. 1 for receiving the contestants' hands before the contestants' forearms contact the top surface of the base means 13.

The device 11 preferably includes indicator means for indicating the angle at which the first and second arm means 15, 17 have been forced downward. The indicator means preferably includes a first member 47 fixedly coupled to the first member 23 of the attachment means for rotation with the first and second arm means 15, 17 and preferably includes a second member 49 fixedly coupled to the base means 13 (see FIGS. 3, 4 and 5). The first member 47 is preferably substantially pointed and the second member 49 is positioned substantially adjacent the first member 47 and has a plurality of indicia markings 51 thereon for coacting with the pointed first member 47 to indicate the angle at which the first and second arm means 15, 17 have been forced downward. The second member 49 is preferably disc-like and is preferably fixedly attached to the second member 25 of the attachment means as by welding or the like substantially midway of the notch 29 in the concave portions 27 thereof as clearly shown in FIGS. 3, 4 and 5. The first member 47 is preferably fixedly attached to the first member 23 of the attachment means as by welding or the like within the notch 29 of the second member 25 of the attachment means adjacent the second member 49 as clearly shown in FIGS. 3, 4 and 5. The indicator means may include a third member 53 substantially identical to the first member 47 and fixedly attached to the first member 23 of the attachment means on the opposite side of the second member 49 of the indicator means than the first member 47 as clearly shown in FIGS. 4 and 5. In this case, the second member 49 includes indicia markings 51 on both sides thereof for allowing each contestant to view the indicator means during the contest.

Figure 6:
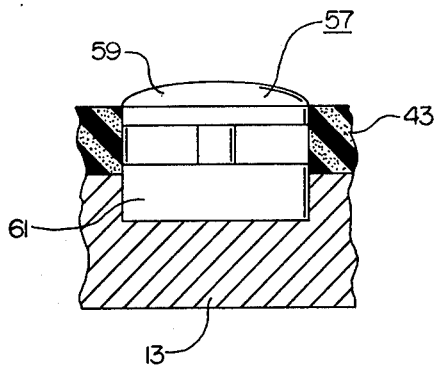
FIG. 6 is a sectional view of a portion thereof as taken on line VI—VI of FIG. 2.
Figure 7:
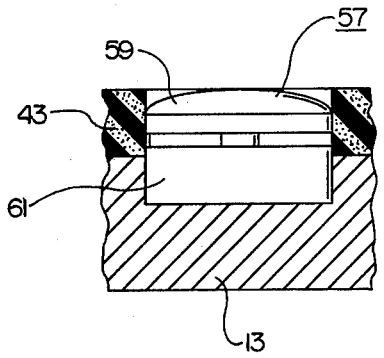
FIG. 7 is a sectional view of a portion thereof substantially similar to FIG. 6 but showing a moved position thereof.

The device 11 preferably includes alarm means for making an audible sound when one of the first and second arm means 15, 17 has been forced downward a predetermined amount. The alarm means preferably includes a first alarm member 55 positioned on the base means 13 at the location where a portion of the hand H of the contestant C' gripping the grip member 19 of the first arm means 15 will contact the third pad member 41 when the first arm means 15 has been forced into a substantially horizontal plane (see FIG. 2). The alarm means preferably includes a second alarm member 57 positioned on the base means 13 at the location where a portion of the hand H of the contestant C″ gripping the grip member 21 of the second arm means 17 will contact the fourth pad member 43 when the second arm means 17 has been forced into a substantially horizontal plane (see FIG. 2). The first and second alarm means 21 may be of any construction apparent to those skilled in the art. For example, each alarm member may include a plunger portion 59 and a bell portion 61 (see FIGS. 6 and 7) joined together in such a manner that when the plunger portion 59 is pressed downward from an up position as shown in FIG. 6 to a down position as shown in FIG. 7, the bell portion 61 will produce an audible sound.

To use the device 11, the base means 13 is placed upon a supporting surface such as a table T or the like (see FIG. 1). Next, each contestant C′, C″ places his elbow E on a respective pad member 37, 39 and grips a respective grip member 19, 21. Then, each contestant C′, C″ will simultaneously attempt to force the other contestant's hand H and forearm F to a substantially horizontal position by applying opposing force to the grip members 19, 21. The contestant who forces the other contestant's hand onto a respective alarm member 55, 57 is declared the winner of the contest. For example, in FIG. 2 the contestant C′ is shown in broken lines as forcing the hand H of the contestant C″ onto the alarm member 57 and is the winner.

Although the present invention has been described and illustrated with respect to a preferred embodiment thereof, it is not to be so limited since changes and modifications may be made therein which are within the full intended scope of the invention.

I claim:

1. A device for use in contests in which two contestants attempt to force one another's forearm from a substantially vertical position to a substantially horizontal position, said device comprising: a base means; a first arm means including a grip member for being gripped by one of the contestants; a second arm means including a grip member for being gripped by the other of the contestants; and an attachment means for pviotally attaching said first and second arm means to said base means in such a manner that when said first or second arm means is forced to pivot downward by one of the contestants, the other of said first or second arm means will be forced to pivot downward a like amount; said first and second arm means crossing one another in such a manner that when said first arm means is forced downward by one of the contestants it will contact and press against said second arm means at the point where said first and second arm means cross one another and that when said second arm means is forced downwardly by one of the contestants it will contact and press against said first arm means at the point where said first and second arm means cross one another.

2. The device of claim 1 in which is included a pad means attached to said base means for receiving each contestant's elbow and for receiving a portion of each contestant's hand when said first and second arm means are in a substantially horizontal position.

3. The device of claim 2 in which said pad means includes a first pad member located substantially directly below said grip member of said first arm means when said first arm means is in a substantially vertical plane for receiving the elbow of the contestant gripping said grip member of said first arm means, in which said pad means includes a second pad member located substantially directly below said grip member of said second arm when said second arm means is in a substantially vertical plane for receiving the elbow of the contestant gripping said grip member of said second arm means, in which said pad means includes a third pad member located substantially directly below said grip member of said first arm means and said grip member of said second arm means when said first arm means has been forced into a substantially horizontal plane for receiving a portion of the hands of both contestants, and in which said pad means includes a fourth pad member located substantially directly below said grip members of said first and second arm means when said second arm means has been forced into a substantially horizontal plane for receiving a portion of the hands of both contestants.

4. The device of claim 1 in which said attachment means includes a first member for fixedly attaching said first and second arm means together and includes a second member for pivotally attaching said first member to said base means.

5. The device of claim 4 in which said first and second arm means and said first member of said attachment means are integrally joined together as a one-piece unit.

6. The device of claim 4 in which said first member of said attachment means has a groove portion and in which a portion of said second member of said attachment means is received within said groove portion of said first member of said attachment means for preventing movement of said first member along its longitudinal axis.

7. The device of claim 4 in which is included indicator means for indicating the angle at which said first and second arm means have been forced downward.

8. The device of claim 7 in which said indicator means includes a first member fixedly coupled to said first member of said attachment means for rotation with said first and second arm means and includes a second member fixedly coupled to said base means, said first member of said indicator means being substantially pointed, said second member of said indicator means being positioned substantially adjacent said first member thereof and having a plurality of indicia markings for coacting with said first member thereof to indicate the angle at which said first and second arm means have been forced downward.

9. The device of claim 4 in which is included alarm means for making an audible sound when one of said first and second arm means has been forced downward a predetermined amount.

10. The device of claim 9 in which said alarm means includes a first alarm member positioned on said base means at the location where a portion of the hand of the contestant gripping said grip member of said first arm means will contact said third pad member when said first arm means has been forced into a substantially horizontal plane, and in which said alarm means includes a second alarm member positioned on said base means at the location where a portion of the hand of the contestant gripping said grip member of said second arm means will contact said fourth pad member when said second arm memans has been forced into a substantially horizontal plane.

* * * * *